US011653143B2

(12) United States Patent
Bradt et al.

(10) Patent No.: US 11,653,143 B2
(45) Date of Patent: May 16, 2023

(54) HELMHOLTZ-RESONATOR FOR MICROPHONE ASSEMBLY

(71) Applicant: Knowles Electronics, LLC, Itasca, IL (US)

(72) Inventors: Christopher Bradt, Chicago, IL (US); Usha Murthy, Lisle, IL (US); Ben Vondersaar, Chicago, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

(21) Appl. No.: 17/137,728

(22) Filed: Dec. 30, 2020

(65) Prior Publication Data

US 2021/0204056 A1 Jul. 1, 2021

Related U.S. Application Data

(60) Provisional application No. 62/954,918, filed on Dec. 30, 2019.

(51) Int. Cl.
*H04R 1/28* (2006.01)
*H04R 1/04* (2006.01)

(52) U.S. Cl.
CPC ..... *H04R 1/2884* (2013.01); *H04R 1/04* (2013.01)

(58) Field of Classification Search
CPC . H04R 1/04; H04R 1/222; H04R 1/28; H04R 1/2807; H04R 1/2823; H04R 1/2838; H04R 1/2846; H04R 1/2853; H04R 19/016; H04R 19/04
See application file for complete search history.

(56) References Cited

U.S. PATENT DOCUMENTS 2,518,805 A * 8/1950 Massa ..... H04R 1/222 181/148
5,539,834 A * 7/1996 Bartlett ..... H04R 1/342 381/170
5,890,072 A * 3/1999 Rabe ..... H04M 1/03 455/550.1

(Continued)

FOREIGN PATENT DOCUMENTS

CN 205510405 U 8/2016
CN 108260037 A 7/2018

(Continued)

OTHER PUBLICATIONS

Notice of Allowance, U.S. Patent Trademark Office U.S. Appl. No. 17/137,702, dated Jan. 20, 2023, 6 pages.

*Primary Examiner* — Ryan Robinson

(57) ABSTRACT

A sensor assembly includes a housing having an external-device interface and a sound port to an interior to the housing. A transducer and an electrical circuit are disposed within the housing. The transducer is acoustically coupled to the sound port while the electrical circuit is electrically coupled to the transducer and the external-device interface. A cavity is formed in a portion of the sensor assembly. In some embodiments, the portion is a base of the housing of the sensor assembly. In other embodiments, the portion is a sound port adapter coupled to the sensor assembly. In any case, the cavity is acoustically coupled to the interior of the housing via the sound port and includes a wall portion structured to modify an acoustic property of the sensor assembly.

20 Claims, 6 Drawing Sheets

(56) References Cited

U.S. PATENT DOCUMENTS 6,950,529 B2 * 9/2005 Wilmink ..... H04R 1/222 381/113
7,242,089 B2 7/2007 Minervini
7,280,855 B2 * 10/2007 Hawker ..... H04M 1/03 381/355
8,170,244 B2 5/2012 Ryan et al.
8,199,939 B2 6/2012 Suvanto et al.
8,325,951 B2 12/2012 Wang
8,433,084 B2 * 4/2013 Conti ..... H04R 19/04 381/174
8,767,982 B2 * 7/2014 Harney ..... H04R 19/04 381/174
8,824,719 B2 * 9/2014 Tanaka ..... H04R 1/38 381/355
8,861,764 B2 * 10/2014 Tanaka ..... H04R 1/04 381/357
8,879,767 B2 * 11/2014 Wickstrom ..... H04R 19/04 381/361
8,965,027 B2 2/2015 Bolognia et al.
8,983,105 B2 3/2015 Reining
9,078,063 B2 7/2015 Loeppert et al.
9,351,062 B2 * 5/2016 Inoda ..... H04R 1/021
9,374,643 B2 6/2016 Szczech et al.
9,479,854 B2 10/2016 Loeppert et al.
9,544,678 B2 * 1/2017 Lorenz ..... H04R 1/2853
9,794,661 B2 10/2017 Watson et al.
9,800,971 B2 10/2017 Manley et al.
10,009,694 B2 * 6/2018 Sibbald ..... G10K 11/17881
10,284,963 B2 * 5/2019 Koymen ..... B81C 1/00158
10,291,973 B2 5/2019 Lim et al.
10,334,339 B2 * 6/2019 Pennock ..... H04R 19/005
10,386,223 B2 * 8/2019 Mogelin ..... H04R 1/2807
10,433,071 B2 10/2019 Pal et al.
10,591,326 B2 3/2020 Lim et al.
10,654,712 B2 5/2020 Albers et al.
10,755,688 B2 * 8/2020 Hayashi ..... G10K 11/1783
10,818,577 B2 * 10/2020 Miehl ..... H04R 1/04
10,820,083 B2 10/2020 Szczech et al.
10,947,108 B2 * 3/2021 Mogelin ..... B81B 3/0045
11,051,094 B2 * 6/2021 Schultz ..... H04R 3/00
11,082,774 B2 * 8/2021 Miehl ..... H04R 19/04
11,128,958 B2 * 9/2021 Allegata ..... H04R 1/021
2007/0261910 A1 * 11/2007 Kasai ..... G01H 11/06 181/142
2008/0247587 A1 * 10/2008 Sato ..... H04R 19/016 381/365
2009/0175477 A1 * 7/2009 Suzuki ..... H04R 19/04 381/355
2013/0070950 A1 * 3/2013 Chen ..... H04R 1/222 381/353
2014/0233756 A1 * 8/2014 Inoda ..... H04R 1/02 381/91
2016/0066095 A1 3/2016 Szczech et al.
2016/0071506 A1 3/2016 Qutub et al.
2018/0029880 A1 2/2018 Lim et al.
2020/0112800 A1 4/2020 Lee et al.
2020/0239301 A1 7/2020 Albers et al.
2020/0286492 A1 * 9/2020 Lesso ..... G10L 17/22
2020/0382862 A1 * 12/2020 Hrudey ..... H04R 1/406
2021/0204050 A1 7/2021 Lynch et al.
2021/0239559 A1 * 8/2021 Unruh ..... H04R 19/04
2021/0321185 A1 * 10/2021 Kim ..... H04R 1/406
2021/0400392 A1 12/2021 Zhang et al.

FOREIGN PATENT DOCUMENTS

CN 109327777 A 2/2019
WO 2020/210134 A1 10/2020
WO 2020210134 A1 10/2020

* cited by examiner

HELMHOLTZ-RESONATOR FOR MICROPHONE ASSEMBLY

RELATED APPLICATIONS

This application claims priority to U.S. Provisional Patent Application Ser. No. 62/954,918 filed on Dec. 30, 2019, entitled "Helmholtz-Resonator for Microphone Assembly," the entire contents of which are hereby incorporated by reference.

TECHNICAL FIELD

The present disclosure relates generally to microphone assemblies and more particularly to microphones with Helmholtz-resonators and other structures for modifying sound input to the microphone assembly.

BACKGROUND

Microphones are used in various devices including hearing aids, mobile phones, smart speakers, personal computers among other devices and equipment. A microphone generally includes a transducer, and in some devices, an integrated circuit disposed in a housing formed by a can or cover mounted on a base. A sound port typically extends through the base (for a bottom port device) or through the top of the housing (for a top port device). In any case, sound traverses through the sound port and is converted into an electrical signal by the transducer.

For certain applications, the microphone is exposed to ultrasonic frequencies emitted by motion sensors, proximity detectors and other sources. These ultrasonic devices can interfere with the resonance response of the microphone and induce audible artifacts in its output. Thus, users can benefit from improved microphone designs that reduce the adverse effects associated with ultrasonic or other signals otherwise detectable by known microphone assemblies.

The various aspects, features and advantages of the present disclosure will become more fully apparent to those having ordinary skill in the art upon consideration of the following Detailed Description and the accompanying drawings described below.

BRIEF DESCRIPTION OF THE DRAWINGS

The disclosure is described in more detail below in connection with the appended drawings and in which like reference numerals represent like components.

DETAILED DESCRIPTION

Figure 1:
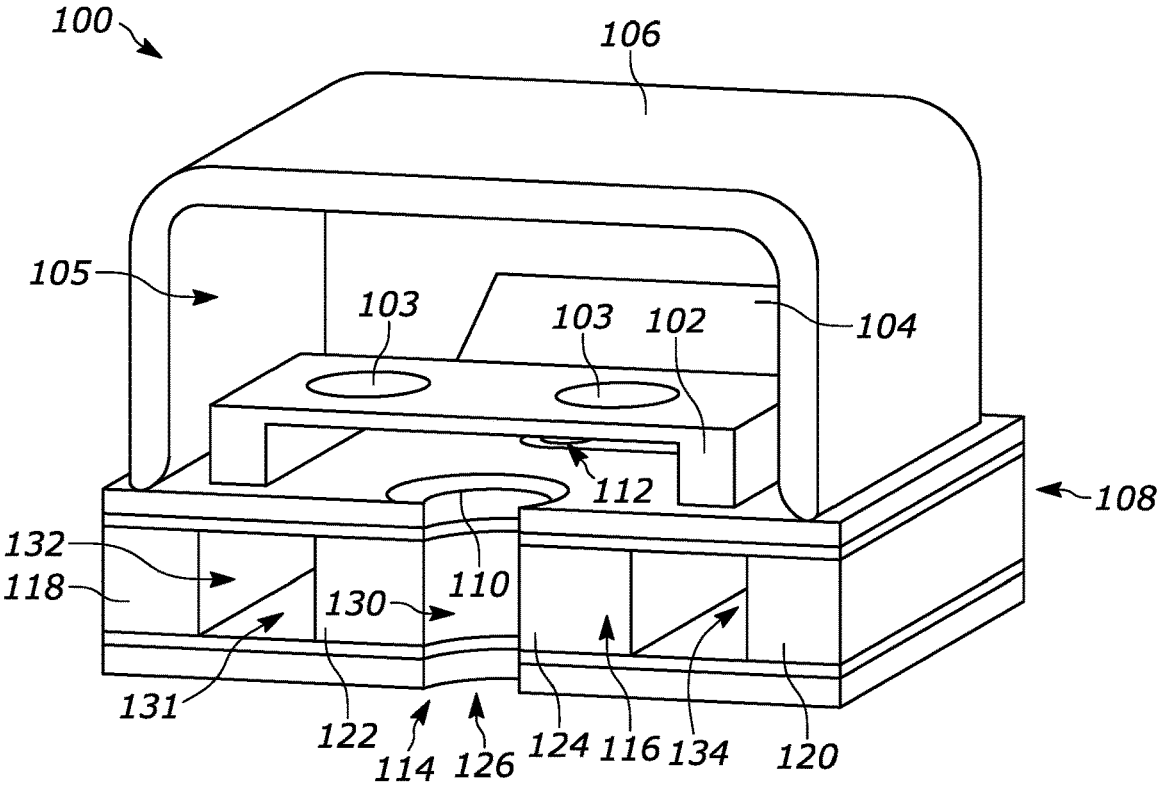
FIG. 1 is a cutaway view of a microphone assembly with a Helmholtz-resonator formed in a base of the microphone assembly.

According to one aspect of the disclosure, a sensor assembly comprises a housing having an external-device interface and a sound port to an interior of the housing. A transducer is disposed within the housing and acoustically coupled to the sound port. An electrical circuit is also disposed within the housing and electrically coupled to the transducer and to the electrical contacts on the external-device interface. A cavity is formed in a portion of the sensor assembly and acoustically coupled to the interior of the housing via the sound port. The cavity has a wall portion structured to modify an acoustic property of the sensor assembly, such as any one or more of an inertance, resistance, compliance, or resonance. In one example, the sensor assembly is a microphone. In other examples, the sensor assembly includes other sensor types such as a pressure sensor, an accelerometer, a gas sensor, a mass flow sensor, etc.

In various embodiments, the cavity and wall portion form a Helmholtz-resonator that modifies any one or more of a frequency of resonance or an amplitude of resonance of the sound propagating through the sound port. The Helmholtz-resonator is configured with a neck connected to one or more chambers, where the sound port is acoustically coupled to the one or more chambers via the neck.

In some embodiments, the cavity and wall portion forming the Helmholtz-resonator are disposed in a base of the sensor assembly. The base is part of the housing and includes the external-device interface and the sound port. In one implementation, the neck and the one or more chambers are formed in or on a same layer of the base. In another implementation, the neck and the one or more chambers are formed in or on different layers of the base, with the neck being formed in or on a first layer and the one or more chambers being formed in or on a second different layer. Other suitable neck and chamber implementations may be contemplated in other embodiments.

In certain embodiments, the cavity and wall portion forming the Helmholtz-resonator are disposed in a sound port adapter that can be fitted to the sensor assembly. The sound port adapter includes an acoustic channel acoustically coupled to the cavity. The sound port adapter includes a sound outlet and a sound inlet disposed on a mounting surface. The sound outlet is acoustically coupled to the sound port when the mounting surface is coupled to a surface (e.g., base) of the sensor assembly.

According to another aspect of the disclosure, a sound port adapter for a microphone assembly comprises a body member having a mounting surface and an acoustic channel disposed through the body member. The acoustic channel includes a sound inlet and a sound outlet. The body member is configured to mount on a surface (e.g., top or bottom surface) of the microphone assembly on which a sound port is disposed. A Helmholtz-resonator comprising a neck and one or more chambers is disposed in the body member. The acoustic channel is acoustically coupled to the one or more chambers by the neck.

In some embodiments, the body member includes a wall portion configured to form a non-straight acoustic path in the acoustic channel to modify any one or more of an inertance or resistance of the acoustic channel. In other embodiments, the body member includes a wall portion configured to obstruct the entry of debris into the acoustic channel for ingress protection.

In various applications, a sound attenuation device, such as a Helmholtz-resonator, can be employed to reduce or dampen the acoustic signal at specific frequencies (e.g., high frequencies) at the input of the microphone or other sensor. FIGS. 1-10 show different configurations of a Helmholtz-resonator for such a sensor assembly. In FIGS. 1-4, the Helmholtz-resonator is constructed in a base of the microphone assembly. In FIGS. 5-10, the Helmholtz-resonator is constructed in a sound port adapter that can be fitted to a sound port of the microphone assembly. If desired, the sound port adapter can be configured for other acoustic tuning (e.g., inertance, resistance, compliance) and/or for ingress protection (e.g., prevent debris from entering the sound port).

A sensor assembly generally includes various components enclosed in a housing. FIG. 1 shows a cutaway view of a microphone assembly 100. The microphone assembly includes a transducer 102 and an electrical circuit 104 (e.g., an integrated circuit) disposed in a housing 105 having a lid or cover 106 mounted on a base 108 having a sound port 110. The transducer, electrical circuit, and sound port are all disposed in an interior of the housing. The transducer is acoustically coupled to the sound port, while the electrical circuit is electrically coupled to the transducer and to electrical contacts 112 on an external-device interface (see FIG. 2). In one implementation, the external-device interface is a surface-mount interface suitable for integrating the microphone assembly to a host device, for example by reflow or wave soldering or some other known or future surface-mount technology. While FIG. 1 shows a microelectromechanical systems (MEMS) capacitive transducer with one or more diaphragms 103, other types of transducers (e.g., capacitive, piezoelectric, optical, electro-acoustic, etc.) may be contemplated in other embodiments. Also, the transducer is not necessarily limited to an acoustic transducer.

The transducer is configured to convert sound into an electrical signal. Once converted, the electrical circuit conditions the electrical signal before providing the conditioned signal at the external-device interface. Such conditioning may include buffering, amplification, filtering, analog-to-digital (A/D) conversion for digital devices, and signal protocol formatting among other processing. The microphone assembly of FIG. 1 shows a bottom port device having the transducer mounted on the base in acoustic communication with the sound port. In other embodiments, the microphone assembly may be a top port device having the transducer mounted over a sound port on the lid.

Figure 2:
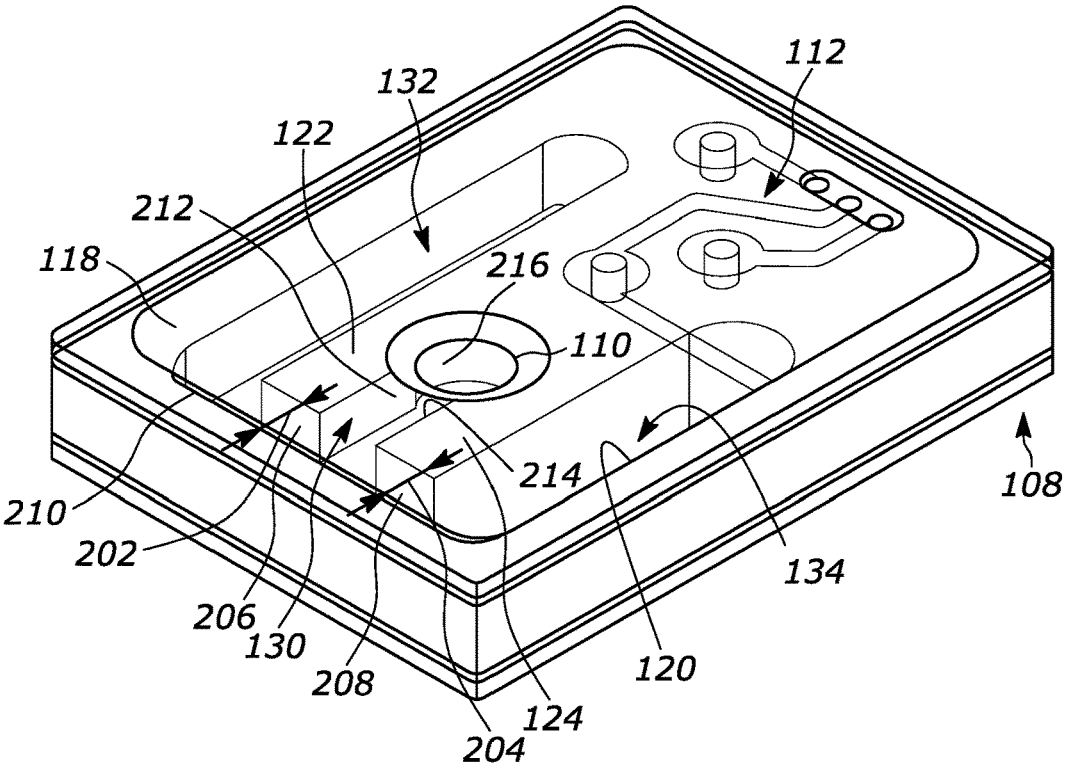
FIG. 2 is a transparent view of the base of the microphone assembly of FIG. 1.

To modify an acoustic property of the microphone assembly, a tuning structure may be formed in a portion of the microphone assembly. In FIGS. 1-2, the tuning structure is a cavity 114 with a wall portion 116 formed in the base of the microphone assembly. The cavity is acoustically coupled to the interior of the housing via or by the sound port. The cavity is defined in part by sidewalls 118, 120. The wall portion includes wall segments 122, 124 and defines an opening 126 connected to the sound port. The opening allows sound to enter the cavity and move to the sound port. The cavity and wall portion can be made by using laser drilling, manual drilling, or other suitable techniques.

As shown in FIGS. 1-2, the cavity and wall portion are structured to form a Helmholtz-resonator that operates to modify a frequency of resonance and/or an amplitude of resonance of the sound propagating through the sound port (e.g., dampen the resonance amplitude, shift the resonance frequency, etc.). The Helmholtz-resonator comprises a narrow opening or neck 130 connected to a chamber 131. In this example, the chamber includes two chambers 132, 134. The neck is formed between the wall segments, while each of the two chambers is formed between a respective wall segment and a sidewall.

The neck acoustically couples the sound port to the two chambers. As shown in FIG. 2, gaps 202, 204 exist between ends 206, 208 of the wall segments and a perimeter 210 of the cavity. Respective surfaces 212, 214 of the wall segments also interface with a surface 216 of the sound port. In this manner, incoming sound from the opening moves through the neck and enters the chambers via the gaps before traveling back through the neck and into the sound port. Although the chambers in FIG. 2 are shown as two finger-shaped chambers with rounded tips, any number of other suitably shaped chambers may be contemplated. Indeed, it is the enclosed volume defined by the chambers that constitutes part of Helmholtz-resonator design. Thus, other suitable neck and chamber configurations for the Helmholtz-resonator may be considered in other embodiments.

While a microphone is shown in FIGS. 1-2, the Helmholtz-resonator can be applied to any type of sensor (e.g., pressure sensor, gas sensor, etc.). More generally, any device can be fitted with a Helmholtz-resonator for resonance tuning. If desired, additional structures can be added to achieve other acoustic tuning features such as inertance, resistance, and/or compliance tuning.

Figure 3:
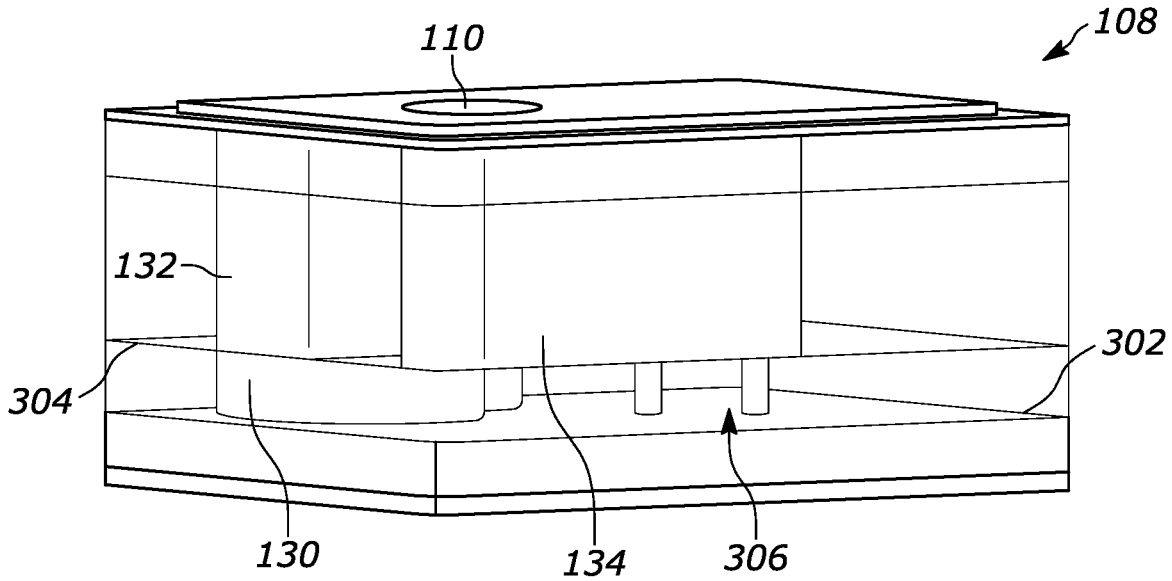
FIG. 3 is a transparent view of another configuration of the base of the microphone assembly of FIG. 1.

Different techniques can be employed to embed the Helmholtz-resonator in the base of the microphone assembly. The base may be comprised of various layers of material (e.g., FR-4, epoxy, plastic, ceramic, glass fiber, etc.). In FIG. 2, the neck and chambers of the Helmholtz-resonator are formed in or on a same layer of the base. In FIG. 3, the neck and chambers of the Helmholtz-resonator are formed in or on different layers of the base. For example, the neck is formed in or on a first layer 302 while the chambers are formed in or on a second different layer 304. A plurality of columns 306 may be used to support the chambers in the second layer. The first and second layers may be made of the same or different material. As shown in FIG. 3, the cavity is split between the first and second layers with the first layer being thinner than the second. However, other configurations of the cavity in different layers may be contemplated in other embodiments.

Figure 4:
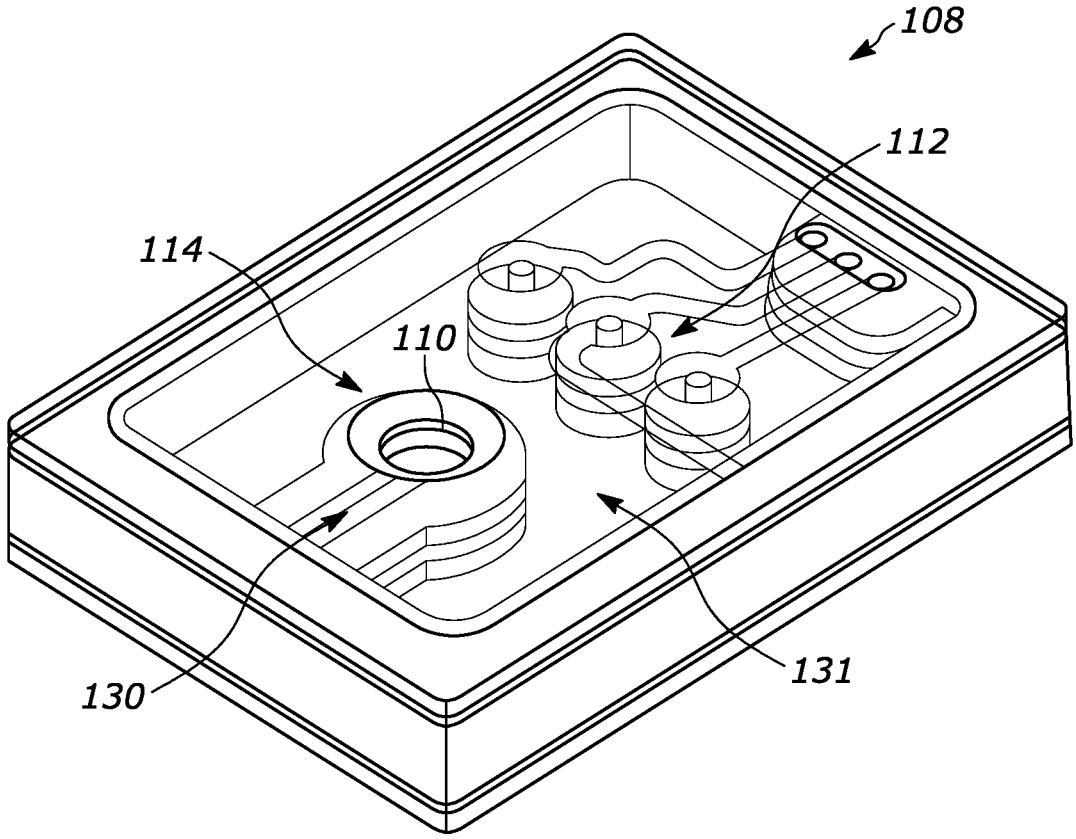
FIG. 4 is a transparent view of yet another configuration of the base of the microphone assembly of FIG. 1.

FIG. 4 shows another configuration of the Helmholtz-resonator in the base of the microphone assembly. In this example, the chamber is a single chamber connected to the neck. The single chamber encompasses almost the entirety of the cavity, wherein the cavity encompasses almost the entirety of the base. The single chamber may be created by etching into the base and around the neck, the sound port, and the electrical contacts. In FIG. 4, the base is made of a copper material, although other suitable materials are contemplated in other embodiments.

In certain embodiments, instead of having the tuning structure in the base of the sensor assembly, a sound port adapter may be configured with the tuning structure to modify various acoustic properties (e.g., inertance, resistance, compliance and/or resonance) of the sensor assembly. FIGS. 5-10 show different configurations of a one-piece sound port adapter that can be fitted to a microphone assembly. The sound port adapter may be made from any suitable material (e.g., metal, plastic, ceramic, glass, etc.) by using any suitable technique such as etching, laser ablation, molding, 3D printing, etc. While FIGS. 5-10 show the sound port adapter as being square in shape, other suitable shapes (e.g., rectangular, trapezoid, oval, etc.) may be contemplated in other embodiments.

Figure 5:
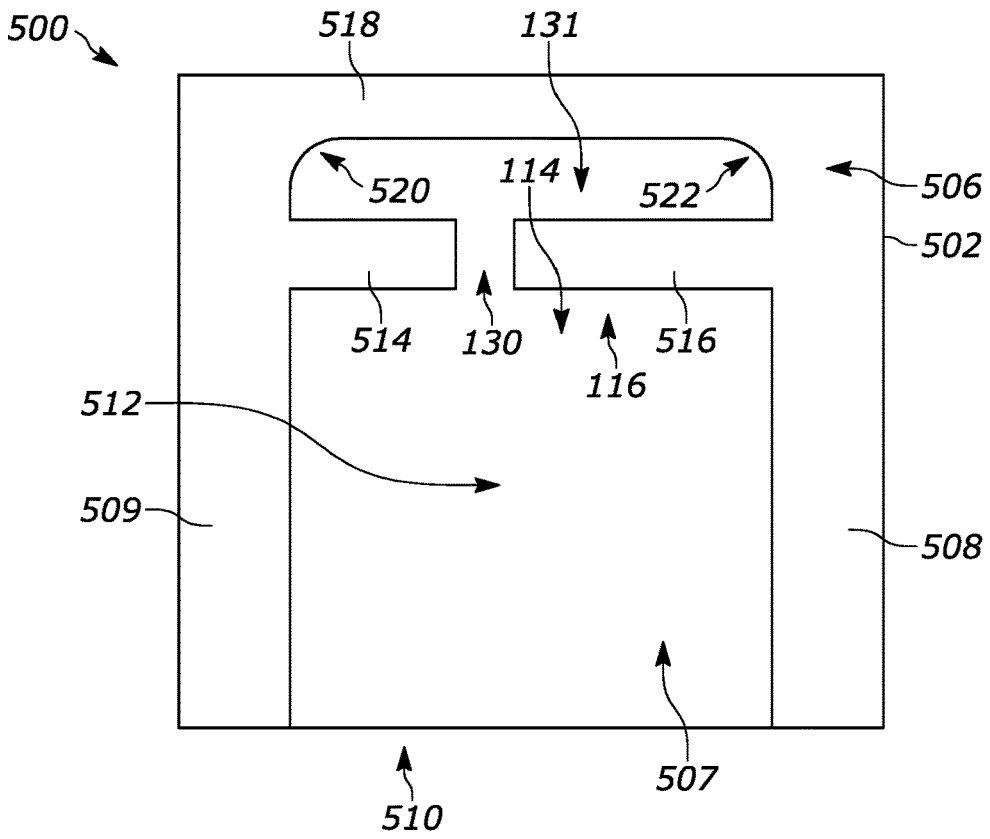
FIG. 5 is a bottom view of a sound port adapter with a Helmholtz-resonator in a first configuration.

FIG. 5 shows a sound port adapter 500 that comprises a body member 502 having a mounting surface 506. The mounting surface includes an acoustic channel 507 defined by sidewalls 508, 509. The acoustic channel is disposed through the body member to create a sound inlet 510 and a sound outlet 512.

The body member includes a Helmholtz-resonator formed by the cavity and wall portion. Here, the wall portion includes wall segments 514, 516 that extend horizontally (e.g., parallel with respect to the sound inlet) into the cavity to define the neck of the Helmholtz-resonator. The chamber of the Helmholtz-resonator is defined by the two wall segments and a third sidewall 518. In this manner, the acoustical channel is acoustically coupled to the chamber by the neck. The chamber is shown to have rounded corners 520, 522, although other shapes may be considered. While one rectangularly-shaped chamber is shown in FIG. 5, any number of other suitably shaped chambers may be contemplated in other embodiments.

Figure 6:
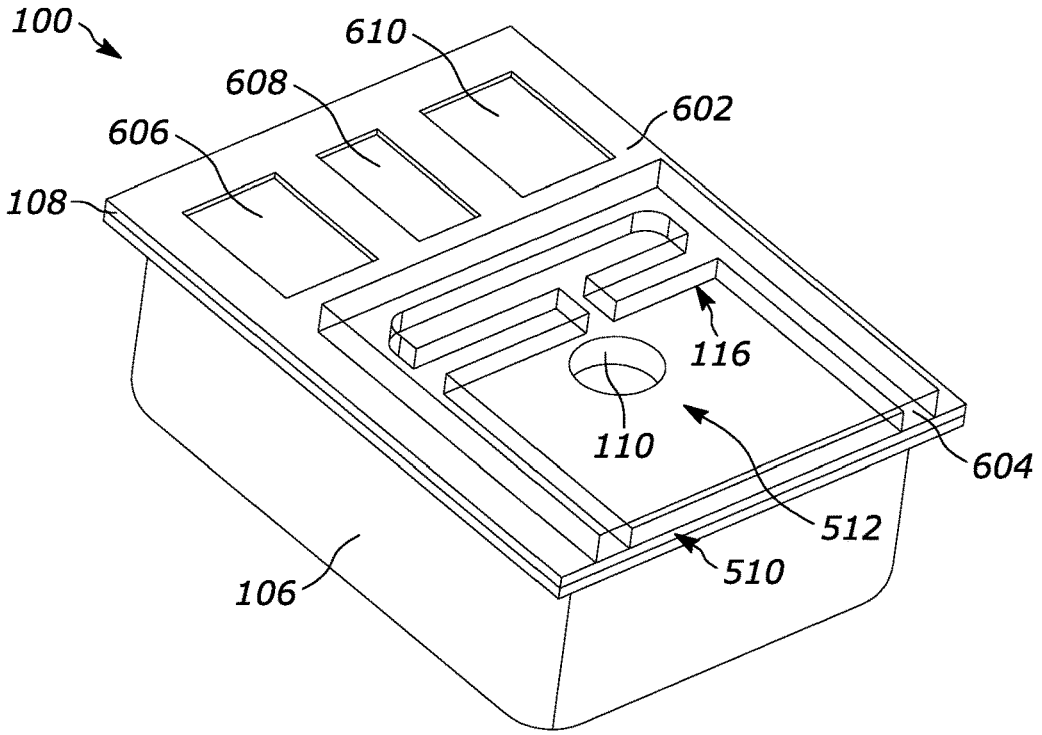
FIG. 6 is a transparent view of the sound port adapter of FIG. 5 coupled to a microphone assembly.

FIG. 6 shows the sound port adapter mounted to a microphone assembly, which may be the same as the microphone assembly 100 with the exception that the base does not include the Helmholtz-resonator. When mounted to the base, the sound outlet is acoustically coupled to the sound port and the sound inlet defines a side port location. In other words, the sound port adapter converts the microphone assembly from a bottom port microphone assembly to a side-port microphone assembly.

To facilitate mounting of the sound port adapter, a surface 602 of the housing on which the sound port is disposed may include a ground plane 604. The shape of the ground plane can correspond to the sidewalls of the sound port adapter such that the sidewalls can be attached to the ground plane (e.g., by using solder or cement). The surface may also include a plurality of contacts pads 606-610 (e.g., supply voltage, clock, data, etc.) for the external-device interface.

Figure 7:
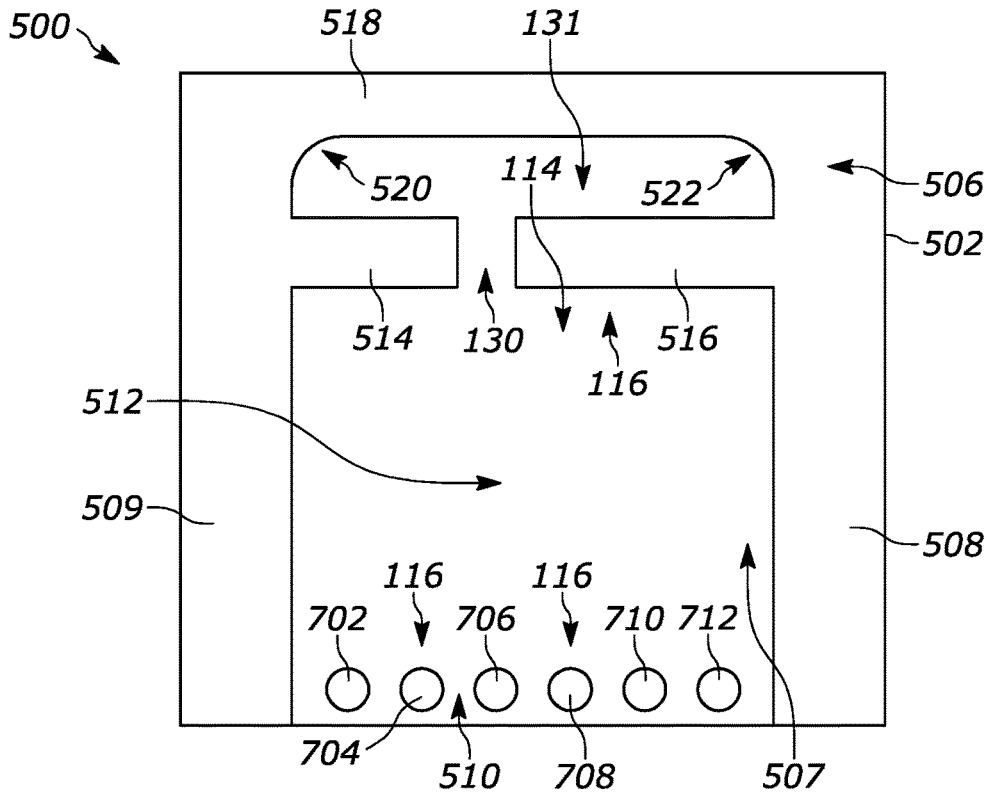
FIG. 7 is a bottom view of a sound port adapter with a Helmholtz-resonator in a second configuration.
Figure 8:
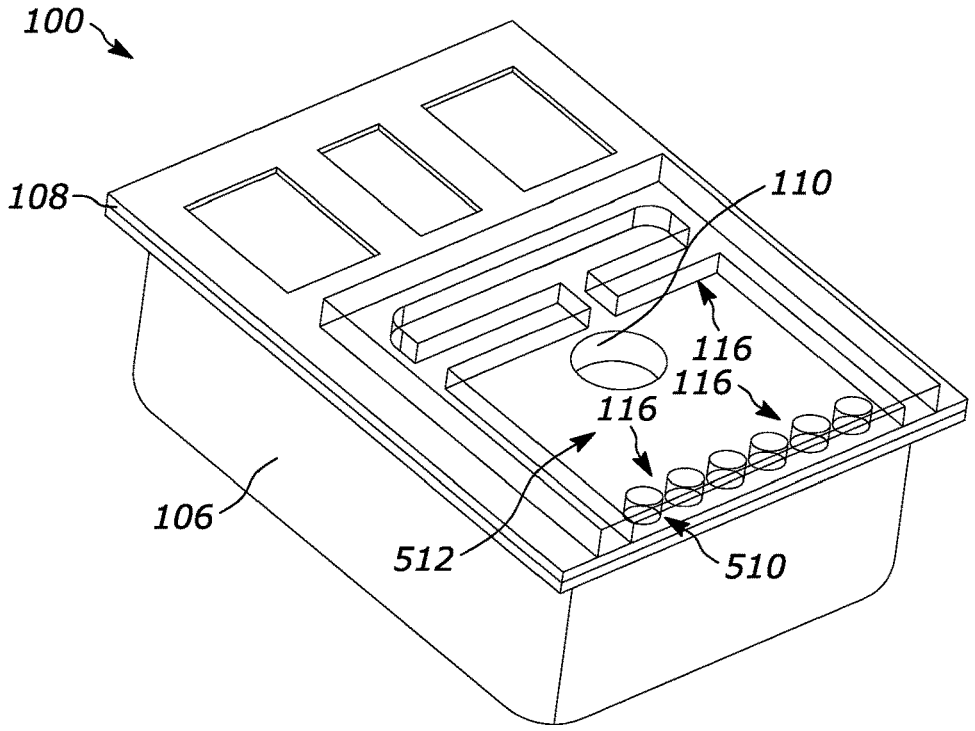
FIG. 8 is a transparent view of the sound port adapter of FIG. 7 coupled to a microphone assembly.

In FIGS. 7-8, in addition to forming the Helmholtz-resonator, the wall portion includes a plurality of discrete wall portions 702-712 arranged horizontally across the acoustic channel (e.g., parallel with respect to the sound inlet). The discrete wall portions serve to modify the resistance of the acoustic channel. In this example, the discrete wall portions are embodied as six equally sized cylindrical pillars. However, any number of suitably sized shapes in repeated patterns may be contemplated in other embodiments.

The discrete wall portions are arranged in spaced-apart relation with the distance between each of the discrete wall portions being adjustable as desired. The space between each of the discrete wall portions forms the sound inlet to allow sound to travel to the sound outlet. This arrangement also acts like a mesh or screen to prevent debris from entering the acoustic channel.

Figure 9:
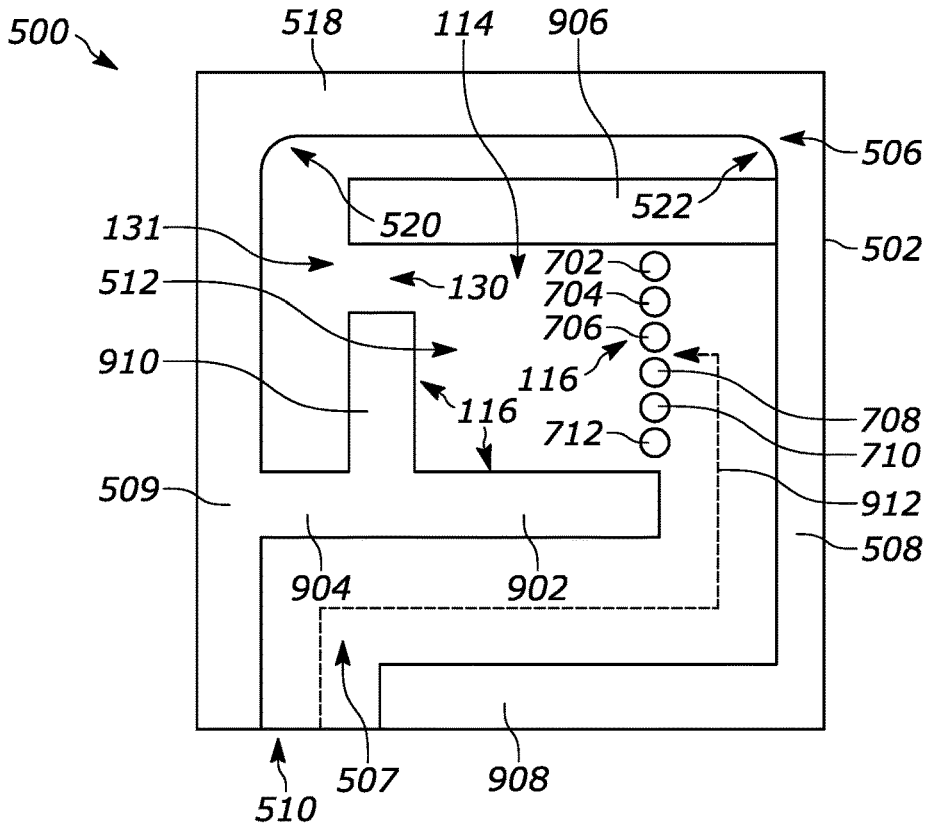
FIG. 9 is a bottom view of a sound port adapter with a Helmholtz-resonator in a third configuration.
Figure 10:
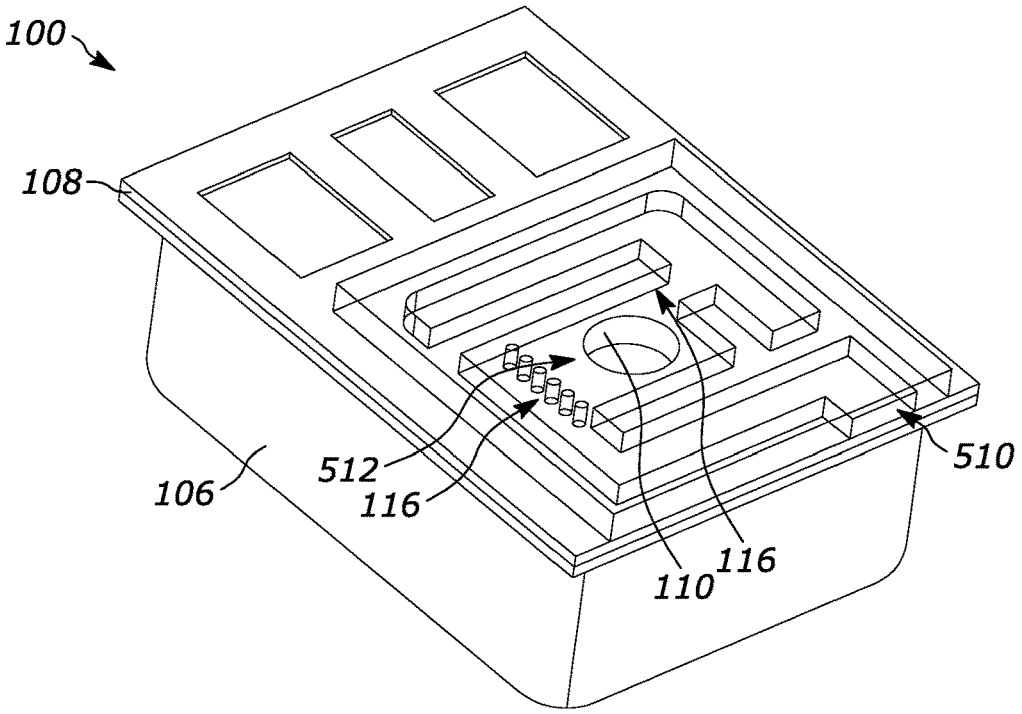
FIG. 10 is a transparent view of the sound port adapter of FIG. 9 coupled to a microphone assembly.

In FIGS. 9-10, in addition to forming the Helmholtz-resonator, the wall portion includes discrete wall portions in a tortuous acoustic channel. In this example, the wall portion is comprised of the cylindrical pillars 702-712 and wall segments 902-910. The wall segments 902-908 are disposed horizontally (e.g., parallel), while the wall segment 910 is disposed vertically (e.g., perpendicular) with respect to the sound inlet. In this configuration, the neck of the Helmholtz-resonator is defined between the wall segments 906 and 910. The chamber of the Helmholtz-resonator is defined by the wall segments 904, 906, 910 and the sidewalls 508, 518.

The sound inlet is narrowed by the placement of the wall segment 908 with respect to the sidewall 509. This arrangement of also defines a non-straight path 912 with three turns for the sound to follow from the sound inlet to the sound outlet. In general, the wall portion may be configured with various wall segments to form any type of non-straight path (e.g., spiral path, twisting path, S-shape path, sinusoidal path, zigzag path, serpentine path, etc.) to modify the inertance of the acoustic channel and to obstruct debris from entering the acoustic channel.

The cylindrical pillars are located near the sound outlet and disposed vertically between the wall segments 902 and 906. In other examples, the cylindrical pillars may be located near the sound inlet. Other configurations of a tortuous acoustic channel with one or more discrete wall portions may be contemplated in other embodiments.

Figure 11:
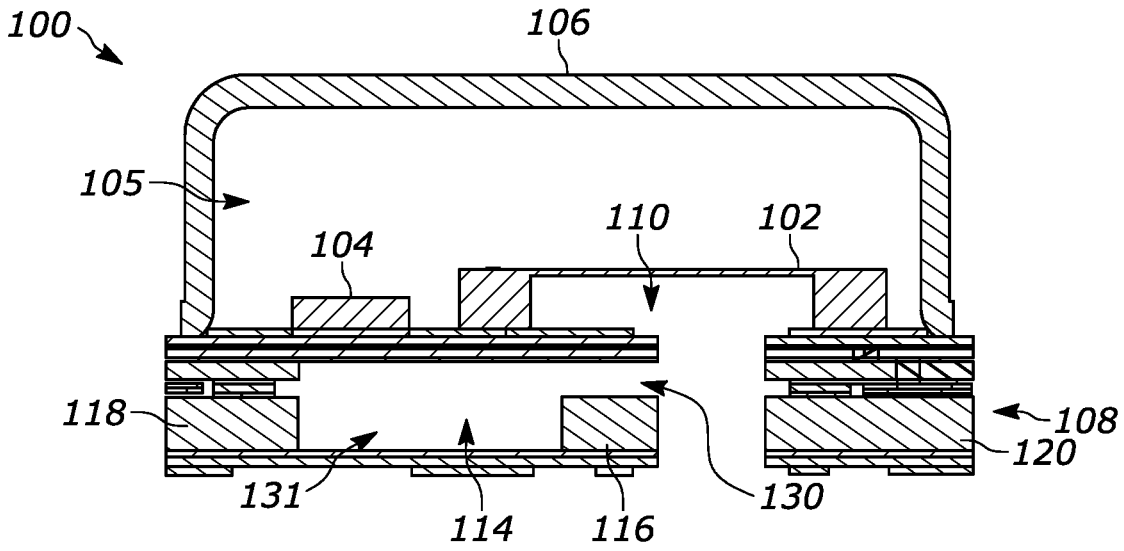
FIG. 11 is a cross-sectional view of another embodiment of the microphone assembly of FIG. 1.
Figure 12:
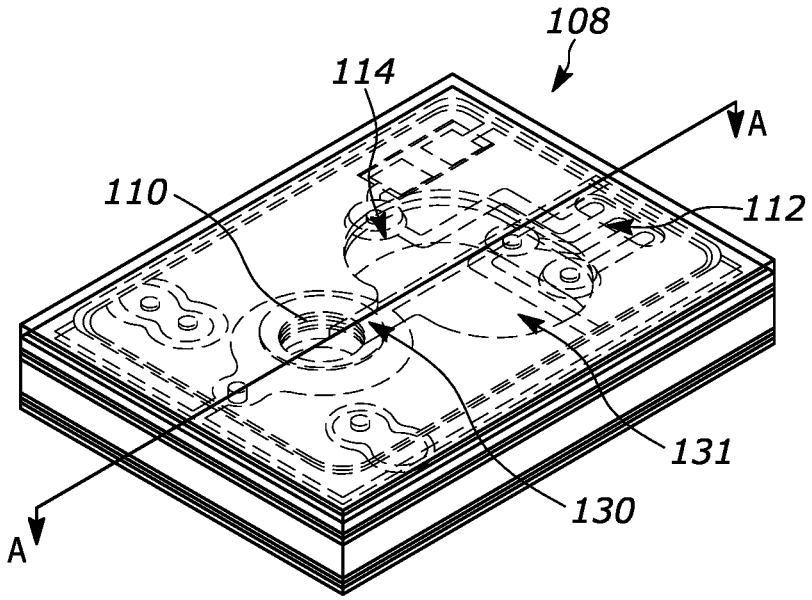
FIG. 12 is a transparent view of the base of the microphone assembly of FIG. 11.

FIGS. 11 and 12 illustrate another embodiment of the microphone assembly 100 with FIG. 11 showing a cross-section of the microphone assembly along lines A-A (see FIG. 12). In this example, the cavity 114 is defined in part by the sidewalls 118, 120 and the wall portion 116. The wall portion is a single segment that has a height less than the height of the base. This allows the wall portion to form the neck of the Helmholtz-resonator. As shown in FIGS. 11 and 12, the chamber of the Helmholtz-resonator is a single circular-shaped chamber embedded in the base. Unlike FIG. 4, the chamber does not encompass the entirety of the base. As desired, other shapes of the chamber (e.g., rectangular, oval, etc.) may be contemplated in other embodiments.

Among other advantages, employing a Helmholtz-resonator near the entry port of a microphone or another sensor can serve to tune the resonance response the device to thereby improve the quality of the output signal. Other benefits will be recognized by those of ordinary skill in the art.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

The invention claimed is:

1. A sensor assembly comprising:

a housing having an external-device interface and a sound port to an interior of the housing;

a transducer disposed within the housing and acoustically coupled to the sound port;

an electrical circuit disposed within the housing and electrically coupled to the transducer and to electrical contacts on the external-device interface;

a cavity formed in a portion of the sensor assembly and acoustically coupled to the interior of the housing by the sound port, the cavity having a wall portion structured to modify an acoustic property of the sensor assembly wherein the cavity and wall portion comprise a neck connected to one or more chambers that define one or more enclosed volumes; and wherein the sound port is acoustically coupled to the one or more chambers by the neck.

2. The assembly of claim 1, wherein the housing comprises a base including the external-device interface and the sound port, and wherein the cavity and the wall portion are formed in the base.

3. The assembly of claim 2, wherein the cavity and wall portion form a Helmholtz-resonator comprising the neck connected to one or more chambers.

4. The assembly of claim 3, wherein the sound port is acoustically coupled to the one or more chambers of the Helmholtz-resonator by the neck.

5. The assembly of claim 4, wherein the neck and the one or more chambers of the Helmholtz-resonator are formed in or on a same layer of the base.

6. The assembly of claim 4, wherein the neck and the one or more chambers of the Helmholtz-resonator are formed in or on different layers of the base, with the neck being formed in or on a first layer and the one or more chambers being formed in or on a second different layer.

7. The assembly of claim 1 further comprising a sound port adapter having an acoustic channel with a sound inlet and a sound outlet on a mounting surface of the sound port adapter, the sound port adapter mounted over the sound port of the housing so that the sound outlet of the sound port adapter is acoustically coupled to the sound port, wherein the cavity and the wall portion are formed in the sound port adapter.

8. The assembly of claim 7, wherein the acoustic channel of the sound port adapter is acoustically coupled to the cavity.

9. The assembly of claim 1, wherein the acoustic property of the sensor assembly includes any one or more of inertance, resistance, compliance or resonance.

10. A microphone assembly comprising:

a housing having a surface-mountable external-device interface and a sound port to an interior of the housing;

an electro-acoustic transducer disposed in the interior of the housing and acoustically coupled to the sound port;

an electrical circuit disposed in the interior of the housing and electrically coupled to the electro-acoustic transducer and to electrical contacts on the external-device interface;

a cavity formed in a portion of the microphone assembly and acoustically coupled to the interior of the housing via the sound port, the cavity having a wall portion defining a neck acoustically coupling the sound port to one or more chambers that define one or more enclosed volumes, wherein the cavity modifies an acoustic property of the microphone assembly.

11. The microphone assembly of claim 10, wherein the cavity and wall portion form a Helmholtz-resonator comprising the neck connected to one or more chambers.

12. The microphone assembly of claim 11, wherein the housing comprises a base including the surface-mountable external-device interface and the sound port, and wherein the Helmholtz-resonator is formed in the base.

13. The microphone assembly of claim 11, wherein the sound port is acoustically coupled to the one or more chambers of the Helmholtz-resonator via the neck.

14. The microphone assembly of claim 13, wherein the neck and the one or more chambers of the Helmholtz-resonator are formed in or on different layers of the base, with the neck being formed in or on a first layer and the one or more chambers being formed in or on a second different layer.

15. The microphone assembly of claim 11 further comprising a sound port adapter having an acoustic channel with a sound inlet and a sound outlet on a mounting surface of the sound port adapter, the sound port adapter mounted over the sound port of the housing so that the sound outlet of the sound port adapter is acoustically coupled to the sound port, wherein the Helmholtz-resonator is formed in the sound port adapter.

16. The microphone assembly of claim 15, wherein the sound inlet is located on a different surface of the sound port adapter than the mounting surface.

17. The microphone assembly of claim 10, wherein the acoustic property of the microphone assembly includes any one or more of inertance, resistance, compliance or resonance.

18. A sound port adapter for a microphone assembly comprising an acoustic transducer disposed in a housing having a sound port on a top or bottom surface of the housing, the sound port adapter comprising:

a body member having a mounting surface configured to mount on the housing of the microphone assembly;

an acoustic channel disposed through the body member, the acoustic channel having a sound inlet and a sound outlet disposed on the mounting surface of the body member; and a Helmholtz-resonator disposed in the body member, the Helmholtz-resonator comprising one or more chambers that define one or more enclosed volumes and a neck, the acoustic channel acoustically coupled to the one or more chambers by the neck.

19. The sound port adapter of claim 18, wherein the Helmholtz-resonator modifies any one or more of a frequency of resonance or an amplitude of sound propagating through the acoustic channel of the sound port adapter.

20. The sound port adapter of claim 18, wherein the sound port adapter includes a wall portion configured to form a non-straight acoustic path in the acoustic channel.

* * * * *